US005350167A

United States Patent [19]

Hansch

[11] Patent Number: 5,350,167

[45] Date of Patent: Sep. 27, 1994

[54] APPARATUS FOR TRANSPORTING SHEET-LIKE PRODUCTS

[75] Inventor: Egon Hansch, Wetzikon, Switzerland

[73] Assignee: Ferag AG, Hinwil, Switzerland

[21] Appl. No.: 173,374

[22] Filed: Dec. 23, 1993

[30] Foreign Application Priority Data

Jan. 14, 1993 [CH] Switzerland ..... 00106/93

[51] Int. Cl.[5] ..... B65H 29/00

[52] U.S. Cl. ..... 271/82; 271/271; 271/277

[58] Field of Search ..... 271/271, 277, 82, 269, 271/204

[56] References Cited

U.S. PATENT DOCUMENTS

| | | |
|---|---|---|
| 3,450,400 | 6/1969 | Guggisberg . |
| 3,671,035 | 6/1972 | Reist . |
| 3,751,324 | 8/1973 | Enskat . |
| 3,826,706 | 7/1974 | Müller . |
| 3,871,943 | 3/1975 | Zodrow . |
| 3,877,692 | 4/1975 | Kluge et al. . |
| 3,955,667 | 5/1976 | Müller et al. . |
| 4,201,286 | 5/1980 | Meier . |
| 4,533,132 | 8/1985 | Wangermann . |
| 4,629,175 | 12/1986 | Fischer et al. . |
| 4,746,007 | 5/1988 | Houseman . |
| 4,852,722 | 8/1989 | Houseman . |
| 4,893,805 | 1/1990 | Eberle . |
| 4,905,818 | 3/1990 | Houseman . |
| 4,905,986 | 3/1990 | Müller . |
| 4,981,291 | 1/1991 | Honegger et al. . |
| 4,982,944 | 1/1991 | Eberle . |
| 5,022,954 | 6/1991 | Plaessmann . |
| 5,052,666 | 10/1991 | Hänsch . |
| 5,094,438 | 3/1992 | Reist et al. . |
| 5,104,108 | 4/1992 | Honegger . |
| 5,110,108 | 5/1992 | Müller . |
| 5,116,452 | 5/1992 | Eder . |
| 5,137,596 | 8/1992 | Potter . |
| 5,292,111 | 3/1994 | Hansch ..... 271/204 X |

FOREIGN PATENT DOCUMENTS

| | | |
|---|---|---|
| 2049850 | 4/1972 | Fed. Rep. of Germany . |
| 2160772 | 6/1973 | Fed. Rep. of Germany . |
| 2135303 | 8/1973 | Fed. Rep. of Germany . |
| 2822060 | 12/1978 | Fed. Rep. of Germany ..... 271/204 |

*Primary Examiner*—Richard A. Schacher

*Attorney, Agent, or Firm*—Willian Brinks Hofer Gilson & Lione

[57] ABSTRACT

An apparatus for transporting sheet-like products includes a belt conveyor with a flexible conveyor belt. The conveyor belt is driven in a conveying direction at a conveying speed. A takeover conveyor has individually controllable clamps which are arranged one behind the other on a carrying member. The clamps are driven in a rotating direction, and the clamp mouths are directed in the takeover region forward in rotating direction. The products fed to the takeover region are in each case pressed against the conveyor belt by a pressing roller at the free end of the first clamping jaw of the clamp. Since the clamp speed of the clamps is greater than the conveying speed, the following clamp thus catches up with the held product and seizes it at the trailing edge.

8 Claims, 8 Drawing Sheets

APPARATUS FOR TRANSPORTING SHEET-LIKE PRODUCTS

BACKGROUND OF THE INVENTION

The present invention relates to an apparatus for transporting sheet-like products, in particular printed products such as magazines and newspapers by means of a system of conveyor belts and controllable grippers.

An apparatus for conveying printed products is disclosed in U.S. Pat. No. 3,955,667 and corresponding Swiss Patent CH-A-592 562 to Erwin Muller. The printed products are fed in imbricated formation on a first conveyor belt to a takeover region where rotating grippers on a second conveyor belt take the printed products and transport them further. The first conveyor belt is of a rocker-like design and is prestressed in the upward direction by means of a spring.

The grippers on the second conveyor belt rotate at a speed that corresponds to the speed of the first conveyor belt, and the space between each gripper on the second conveyor belt corresponds to the spacing of the leading edges of the printed products. Each gripper comprises a fixed upper clamping jaw and a lower movable clamping jaw or tongue which is arranged on a shank and rotates both towards and away from the upper clamping jaw.

When the clamp is in the open position, the shank is extended toward the first conveyor belt and is swiveled about its longitudinal axis, so that the movable clamping tongue is directed at right angles to the rotating direction and to the fixed clamping jaw. The free end of the shank of each gripper bears on the upper side of a printed product and ahead of the leading edge of the following printing product. To seize a printed product, the shank is swiveled and the movable clamping tongue engages the printed product from underneath at its leading edge. The upward displacement of the shank causes the clamping jaw to close, and the printed product is then clamped at its leading edge between the fixed clamping jaw and the movable clamping jaw.

U.S. Pat. No. 3,671,035 and corresponding Swiss Patent CH-A-468923 to Walter Reist disclose an apparatus for transporting printed products such as newspapers in imbricated formation by means of a belt conveyor with grippers. The imbricated printed products are conveyed from a printing room on a first belt conveyor to a second takeover belt conveyor having grippers arranged on the conveyor that runs at an angle past the first belt conveyor. The grippers are arranged such that there are two parallel rows of grippers on each side of the conveyor. The grippers on the second takeover conveyor have a fixed clamping jaw and a movable clamping jaw arranged on a shank which can be turned and displaced in a longitudinal direction.

At the point the printed products are transferred from the first conveyor to the second takeover conveyor, the printed products bend as a result of the angle between the two belt conveyors. The bend in the printed products causes the underlying trailing edge of the printed product to be exposed and rest on the fixed clamping jaw. The movable clamping jaw is then rotated such that it is positioned above the fixed clamping jaw and the printed product is then clamped between the two clamping jaws.

U.S. Pat. No. 4,905,986 and corresponding European Patent No. A-0 300 171 to Erwin Muller also disclose an apparatus with grippers for conveying imbricated printed products. The printed products are feed in imbricated formation onto a belt conveyor having grippers such that the leading edge of each printed product is covered by the one in front of it.

The grippers on the belt conveyor are individually controllable and are separated by a distance corresponding to the distance between the leading edges of the printed products. The grippers have a fixed clamping jaw and a movable clamping jaw. The fixed clamping jaw of the gripper rests against the bottom of the printed product to be seized at the leading edge.

In order to seize a printed product at its covered leading edge, the movable clamping jaw raises the leading edge of the printed product covering the product to be seized which allows the movable clamping jaw to clamp the desired printed product between the movable clamping jaw and the fixed clamping jaw.

Another apparatus used to convey printed products is disclosed in U.S. Pat. No. 4,201,286 and corresponding Swiss Patent CH-A-618 398 to Jacques Meier. The imbricated printed products are conveyed from a printing room on a first belt conveyor to a second takeover belt conveyor which runs at an angle past the first belt conveyor. The takeover conveyor has individually controllable clamps and revolves continuously in a horizontal direction above the end of the upwardly moving first belt conveyor. The takeover conveyor has a takeover region with a transfer wheel which in each case releases a clamp whenever the leading edge of a printed product has been introduced by the first belt conveyor into the open clamp.

Therefore, a primary object of the present invention is to provide an apparatus for transporting sheet-like products which allows the products to be seized at their trailing edge by a conveyor having grippers at a high processing speed irrespective of the position of the conveyor feeding the printed products.

SUMMARY OF THE INVENTION

An apparatus for transporting sheet-like products comprising:

- a continuously circulating belt conveyor having a flexible conveyor belt driven in a conveying direction at a conveying speed for transporting the products;
- a takeover conveyor having a rotating carrying member driven in a second rotating direction;
- a plurality of individually controllable clamps successively mounted on the carrying member to rotate at a clamp speed, the clamps having a first clamping jaw and a second clamping jaw and a clamp mouth defined therebetween;
- a takeover region wherein the products are transferred from the conveyor belt to the clamps;
- in the takeover region, the clamp speed being greater than the conveying speed, the clamp mouth being directed forward in the conveying direction to seize the products at their trailing end, and the first clamping jaw of the clamps facing the conveyor belt and pressing the product to be seized by a following clamp against the conveyor belt firmly enough to be taken along, in order to convey it further at the conveying speed; and
- means disposed on the first clamping jaw for permitting relative movement between the first clamping jaw and the product.

BRIEF DESCRIPTION OF THE DRAWINGS

The present invention is now described in detail with reference to the following drawings.

DETAILED DESCRIPTION OF THE PRESENTLY PREFERRED EMBODIMENTS

Figure 1:
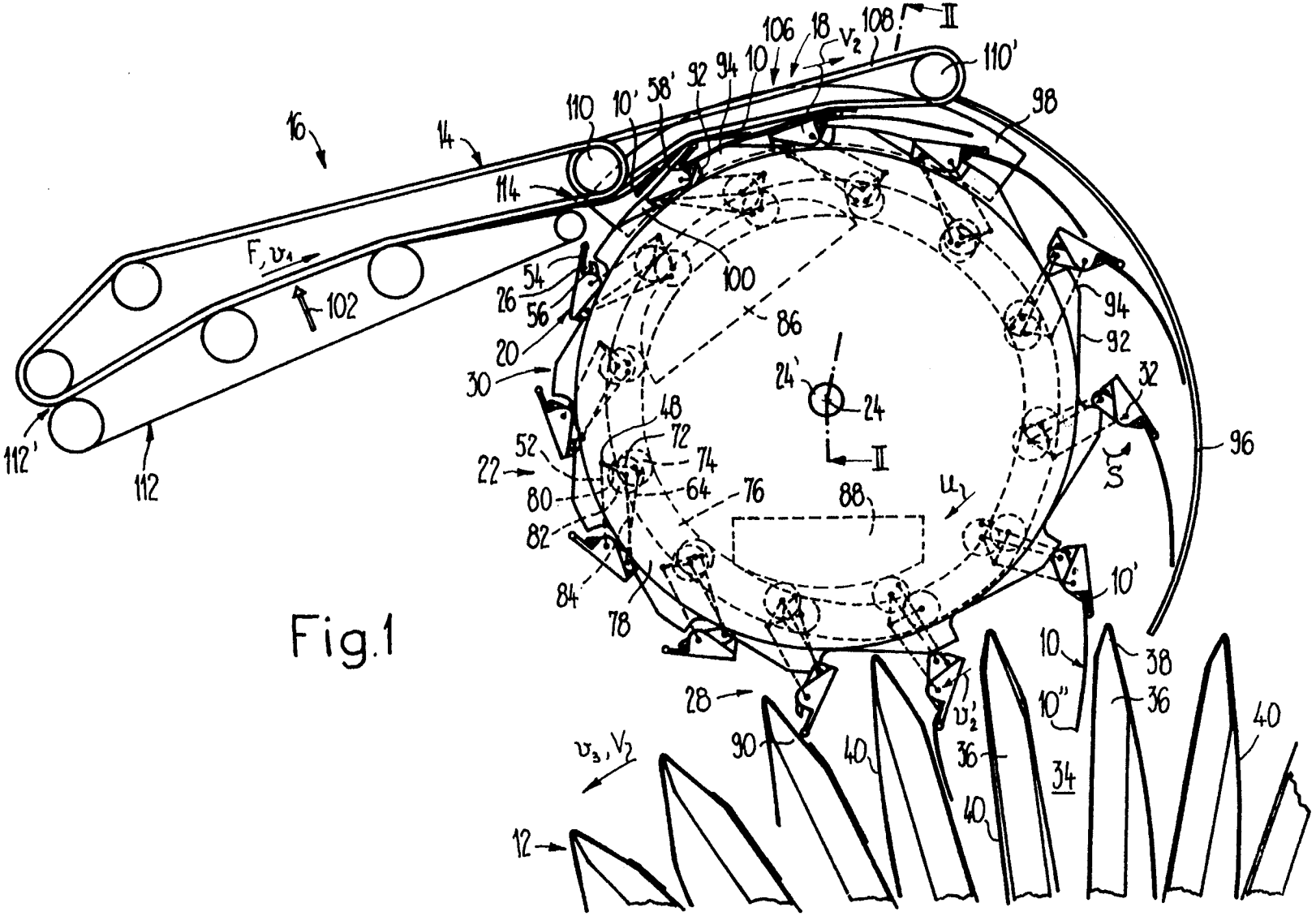
FIG. 1 illustrates a front view of a preferred embodiment of the apparatus for transporting sheet-like products.

FIG. 1 illustrates an apparatus for delivering sheet-like printed products 10, such as cards, to a drum-like processing device 12. A conveying device 16, shown as conveyor 14, transports the printed products 10 in conveying direction F and at conveying speed $v_1$ to a takeover region 18. Underneath the conveying device 16 is a transfer conveyor 22 that rises slightly and is equipped with individually controllable clamps 20 mounted on a wheel-like carrying member 30. The transfer conveyor is driven in a circulating manner in rotating direction U about an axis of rotation 24.

In the takeover region 18, the clamps 20 move in the same direction as conveying direction F and have a clamp speed $v_2$ which is greater than conveying speed $v_1$. Each clamp 20 seizes a product 10 at its trailing edge 10' in the takeover region 18, and then transports the product 10 to a transfer region 28, which is opposite of the takeover region 18. When the clamps 20 move from the takeover region 18 to the transfer region 28, the clamps 20 are swiveled in a direction opposite to rotating direction U about a swivel axis 32 which runs parallel to the axis of rotation 24. The swiveling of the clamps 20 allows the products 10 to be inserted by their leading edges 10'', opposite the trailing edge 10', into pocket-shaped receiving parts 34 of the processing device 12.

The receiving parts 34 of the drum-like processing device 12 are bounded by walls 36 which run in a radial direction and have on their radially outer free ends saddle-like rests 38, which run parallel to the horizontal axis of rotation (not shown) of the processing device 12. Printed products 40 are folded such that they are astride rests 38 and sheet-like products 10 can be adhesively attached to the printed products 40 by means of the transfer conveyor 22 in the transfer region 28.

The drum-like processing device 12 described herein is disclosed in detail in Swiss Patent Application No. 00 060/92-6 and corresponding European Patent Application, Publication No. 0 550 828. Similar drum-like processing devices are well known in the art and are described in U.S. Pat. No. 5,052,667 (European Patent A-0,351,425, U.S. Pat. No. 5,052,666 (European Patent A-0,351,424), and U.S. Pat. No. 5,104,108 (European Patent A-0,346,578) which are incorporated herein by reference.

Figure 2:
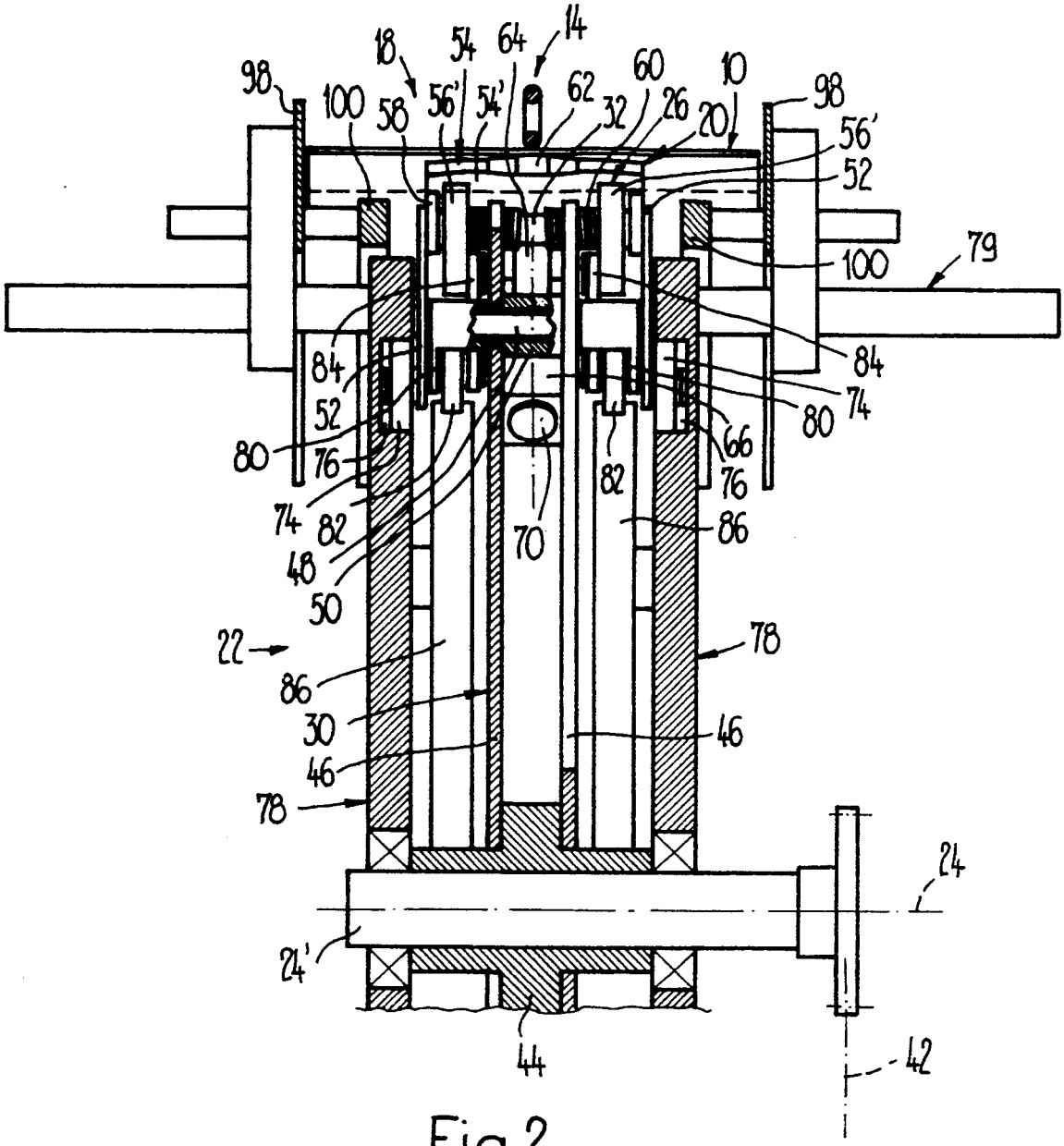
FIG. 2 shows an enlarged cross-section taken along line II—II of FIG. 1.

The design of the transfer conveyor 22 will now be described in more detail with reference to FIGS. 1 through 5. As shown in FIG. 2, the rotary shaft 24' of the transfer conveyor 22 is coaxial with the axis of rotation 24 and is continuously driven in rotating direction U by means of a chain drive 42. Bearing element 44 is keyed-on rotary shaft 24, and wheel-like carrying member 30 is seated on bearing element 44 in a rotationally fixed manner.

The wheel-like carrying member 30 has two parallel round carrying disks 46 which are at right angles to the axis of rotation 24. Twelve bearing shafts 48 pass through the round carrying disks 46 at fixed intervals in a pitch circle coaxial with the axis of rotation 24. The spacing between the carrying disks 46 is determined by the bearing element 44 and by spacers 50 passing through the bearing shafts 48. A rotatable swivel level 52 is fastened by means of spacers 50 to the carrying disks 46 at each end of the bearing shafts 48. The swivel levers 52 are parallel to each other and are connected at their free ends by means of a swivel spindle 32.

Mounted on the swivel spindle 32 are a plate-like first clamping jaw 54 and a second clamping jaw 56 having two clamping fingers 56'. Both the first clamping jaw 54 and the second clamping jaw are freely rotatable. The first clamping jaw 54 has plates 58 formed on a flat clamping jaw part 54' which pass through the swivel spindle 32 and protrude at right angles to the flat clamping jaw part 54. The first clamping jaw projects beyond the actively clamping lever arm of the clamping fingers 56'. The clamping fingers 56' through which the swivel spindle 32 passes have a double-lever-like design. Between the first clamping jaw 54 and the clamping fingers 56', a helical spring 60 engages the swivel spindle 32, in order to prestress the two clamping jaws 54 and 56 toward each other in the closing direction.

Figure 3:
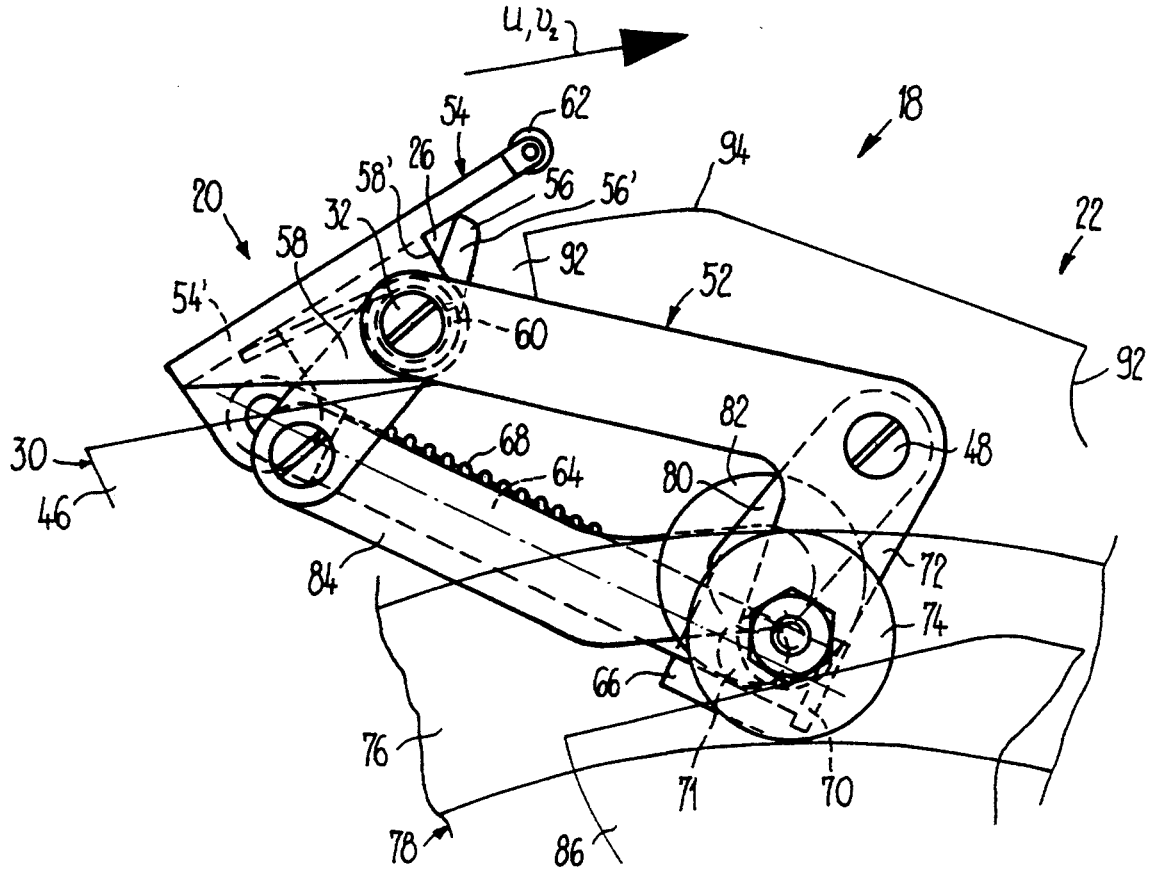
FIG. 3 illustrates an enlarged clamp swiveled into the takeover position with a closed clamp mouth.
Figure 5:
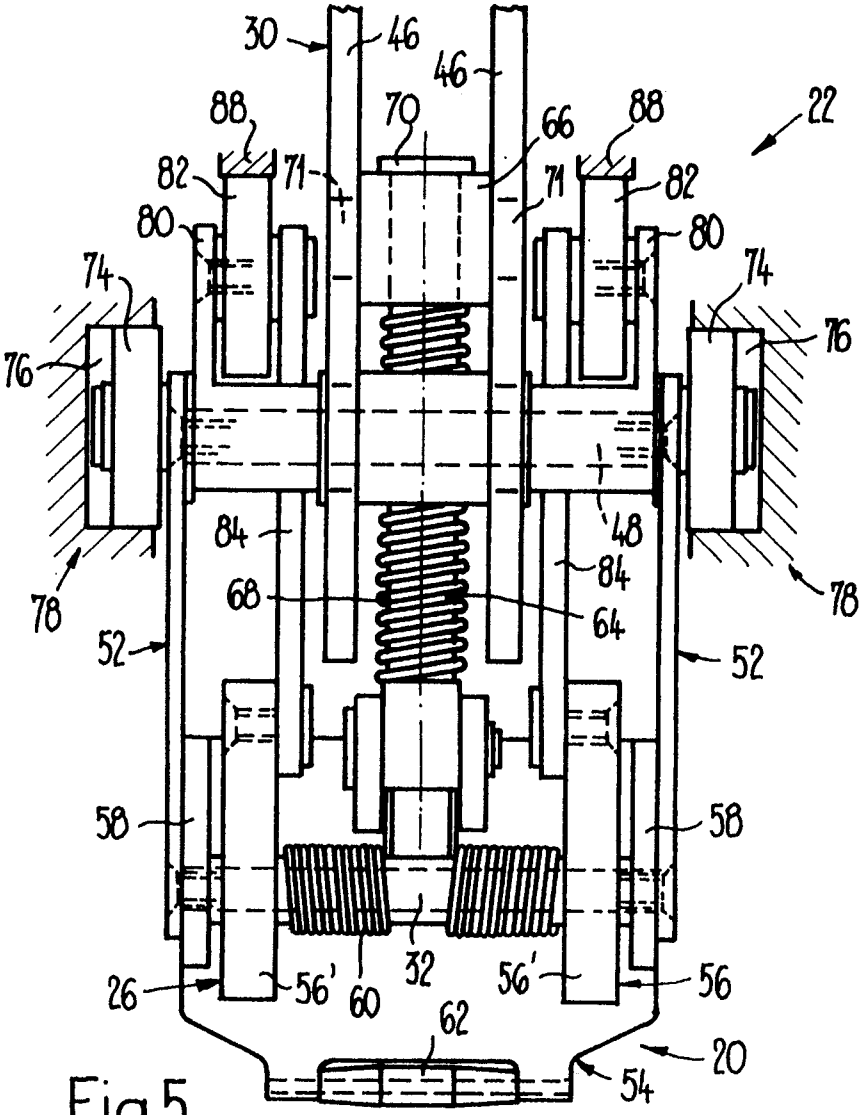
FIG. 5 shows a side view of the clamp in the direction of the arrow V in FIG. 4.
Figure 4:
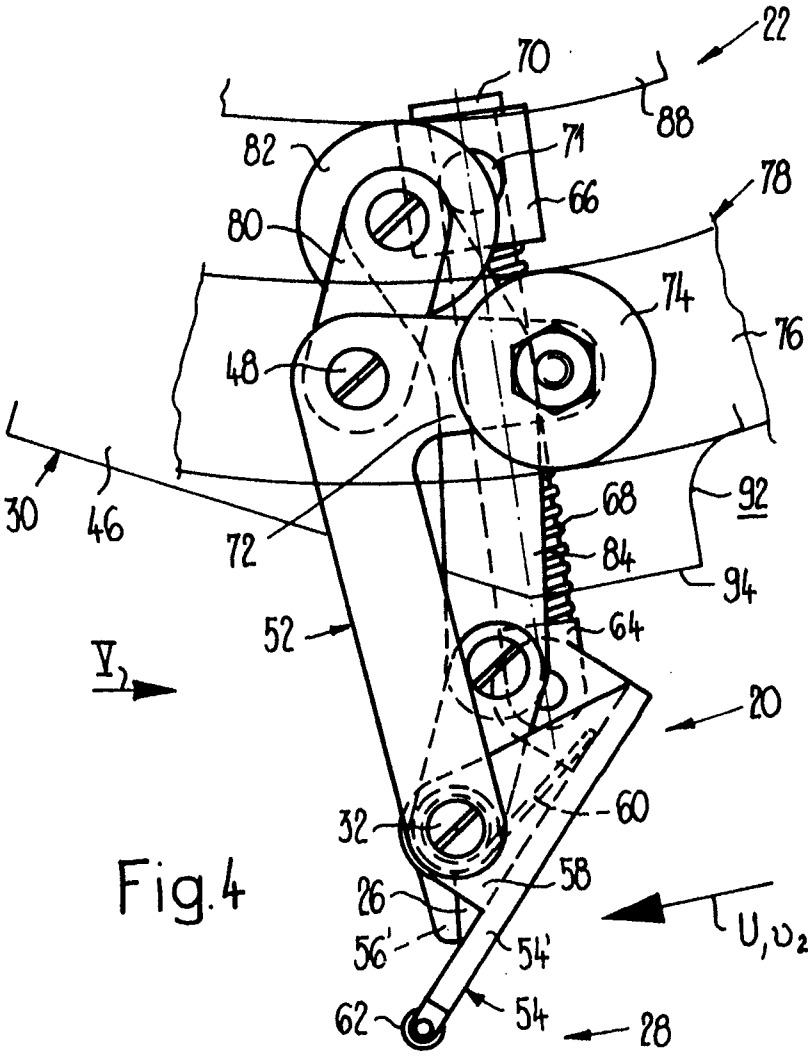
FIG. 4 illustrates the clamp in FIG. 3 in the transfer position.

As shown in FIGS. 1, 3 and 4, in the takeover region 18, the clamp mouth 26 which is formed by clamping jaws 54 and 56 is directed forward in the rotating direction U. Mounted at the end of the first clamping jaw 54 is a rotatable pressing roller 62 which extends beyond the clamping fingers 56'. The longitudinal axis of the pressing roller 62 is parallel to the axis of rotation 24 and swivel axis 32.

A guiding bar 64 is articulated on the first clamping jaw 54 at the end opposite of the pressing roller 62. The guiding bar 64 has a shank-like design and passes through a bearing element 66 which is arranged between the carrying disks 46. The bearing element 66 is mounted on the carrying disks 46 such that it can rotate freely. The guiding bar 64 is enveloped or surrounded by a compression spring element 68 which is supported at one end on the bearing element 66 and on the other end by the guiding bar 64 next to where the guiding bar is coupled to the first clamping jaw 54. The guiding bar 64 passes freely through the bearing element 66 and has a stop disk 70 which interacts with the bearing element 66 to fix the clamp guiding position of the guiding bar 64.

The bearing element 66 is swivel-mounted on the wheel-like carrying member 30 by means of journals 71. The bearing element 66 is inwardly offset in the radial direction, opposite rotating direction U, with respect to the bearing shaft 48 so that the first clamping jaw 54 is mounted on the wheel-like carrying member 30 in the manner of a crank gear. The swivel levers 52 form the crank, the guiding bar 65 forms the rocker, and the first clamping jaw 54 forms the connecting rod.

A control arm 72 is formed on the swivel levers 52 like an angle lever and has at is free end on the outer side facing away from the clamping jaws 54 and 56 a freely rotatable control roller 74. The control rollers 74 run in enclosed slot-like control links 76 which run around the rotary shaft 24'. The control links 76 are formed onto link plates 78, parallel to the carrying disks 46. The link plates 78 are supported on a frame 79. The rotary shaft 24' is rotatably mounted on the link plates 78.

As shown in FIGS. 1 and 3, the control links 76 are shaped such that in takeover region 18 the swivel levers 52 swivel in the opposite direction of rotating direction U into a takeover position. Controlled by the guiding bars 64, the clamps 20 are swiveled in such a way that the clamp mouth 26 is directed forward in rotating direction U. This position of the clamps 20 may also be referred to as the takeover position. In this position, the first clamping jaw 54 forms an acute angle, preferably about 10°, with a tangent to the path of rotation.

The control links 76 are shaped so that between the takeover region 18 and the transfer region 28, the guiding bars 64 are swiveled forward in rotating direction U, into a transfer position. In this transfer position, the guiding bars 64 extend radially with respect to the axis of rotation 24. As a result of the swiveling of the guiding bar 64 in the transfer position, the first clamping jaw 54, and consequently the clamp 20 are swiveled in swiveling direction S, opposite rotating direction U. As shown in FIG. 4, the angle formed by the first clamping jaw 54 and a tangent to the path of rotation increases in the transfer position and is preferably about 60°–70°.

Rotatably mounted on the bearing shaft between the carrying disk 46 and the swivel level 52 is a crank 80 which has on one end a rotatable follow-up roller 82. The follow-up roller 82 is further connected to the clamping finger 56' of the second clamping jaw 56 by connecting rod 84. The connecting rods 84 are located on the clamping fingers 56' on the side opposite of the clamping arm.

In the takeover region 18, opening links 86, fastened on the link plates 78 interact with the follow-up rollers 82. Similarly, in the transfer region 28, follow-up rollers 82 are provided in order to prevent swiveling of the second clamping jaw 56 when the clamp 20, more particularly, the first clamping jaw 54 is opened by the action of counter bearings 90. As shown in FIG. 1, the counter bearings 90 are formed by the walls 36 or rests 38.

The wheel-like carrying disks 46 have recesses 92 on the their outside edges in which the clamps 20 engage in the takeover position. In between the recesses 92 in which the clamps 20 engage are sawtooth-like projections having outer surfaces 94 which form guiding members for the trailing edge 10' of the products 10. As shown in FIG. 1, the outer surface 94 of the sawtooth-like projections is either in line with the free end of the second clamping jaw 56 or is further away (measured from the axis of rotation 24) from the free end of the second clamping jaw 56 when the clamping fingers 56' are swiveled into their open position.

The inner end of the clamp mouth 26 is formed by plates 58, the leading edge 58' of which forms a stop for the trailing edge 10' of the products 10. Between the takeover region 18 and the transfer region 28, a guide plate 96 is provided in order to guide the leading edge 10'' and prevent rearward bending of the products 10 during transportation by the transfer conveyor 22.

Furthermore, in the takeover region 18 on both sides of the path of rotation of the clamps 20, lateral guide plates 98 are fastened to the frame 79. The lateral guide plates 98 direct the products 10 and prevent lateral displacement of the products 10 during the takeover by the transfer conveyor 22. Between the lateral guide plates 98 and the path of rotation of the clamps 20, guide profiles 100 are fastened on the frame 79 and arranged coaxially to the axis of rotation 24. In the takeover region 18, the guide profiles 100 support the products 10 on their inner sides.

Figure 6:
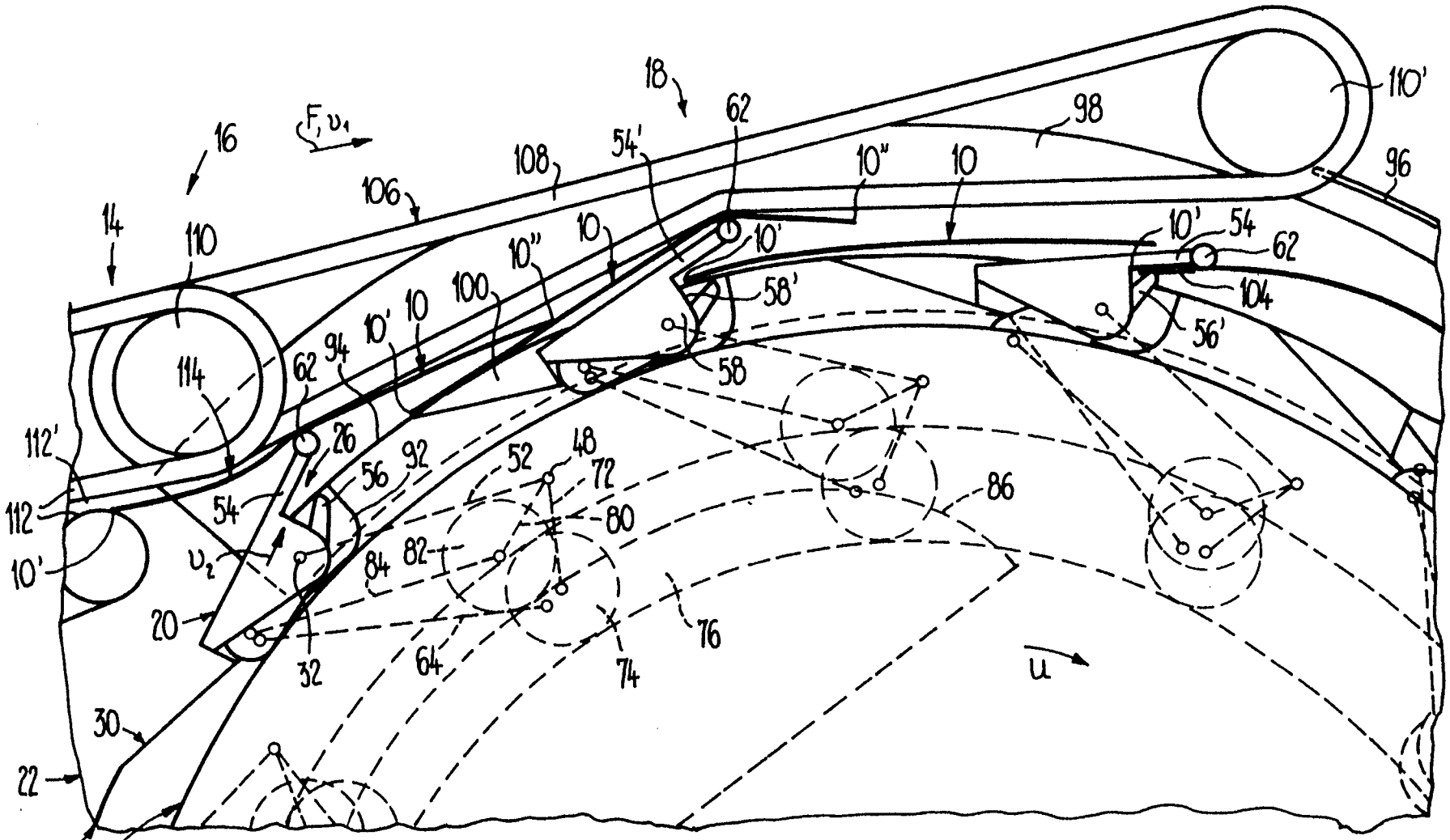
FIGS. 6 and 7 illustrate two front views of the takeover region at two different points during a working cycle, one half working cycles apart.

As shown in FIG. 1, an adhesive applying device 102 is arranged above the transfer conveyor 22 in order to provide the products 10 with a layer of adhesive 104 as indicated in FIG. 6. When the product 10 is seized by a clamp 20 and lies between the clamping fingers 56' of the second clamping jaw 56, the adhesive layer 104 covers that portion of product 10 between the trailing edge 10' of the product 10 and the pressing roller 62.

The adhesive layer 104 is located on the underside of the products 10 facing the axis of rotation 24. However, it is also possible for the adhesive applying device 102 to provide an adhesive layer 104 to another part of the product 10. If the products 10 are not to be adhesively attached to the printed products, the adhesive applying device 102 is switched off, or no such device is used at all.

The conveying device 16 further has a strap conveyor 106 with an endless conveyor strap 108 made of flexible material. The conveyor strap 108 has a generally round cross-section and wraps around deflecting rollers 110 and 110' positioned at the beginning and at the end of the takeover region 18. The conveyor strap 108 together with the pressing roller 62 of the clamps 20 forms a clamping nip for the products 10.

Arranged upstream from the strap conveyor 106 is a belt conveyor 14 which has a pair of conveyor belts 112. A conveying nip 112' is formed between the belts 112 which feeds the products 10 in conveying direction F to the takeover region 18. The strap conveyor 106 and the pair of conveyor belts 112 are driven in a continuous circular manner at conveying speed $v_1$ in conveying direction F. Conveying speed $v_1$ is less than the speed $v_2$ of the clamps 20 in the takeover region 18.

Figure 7:
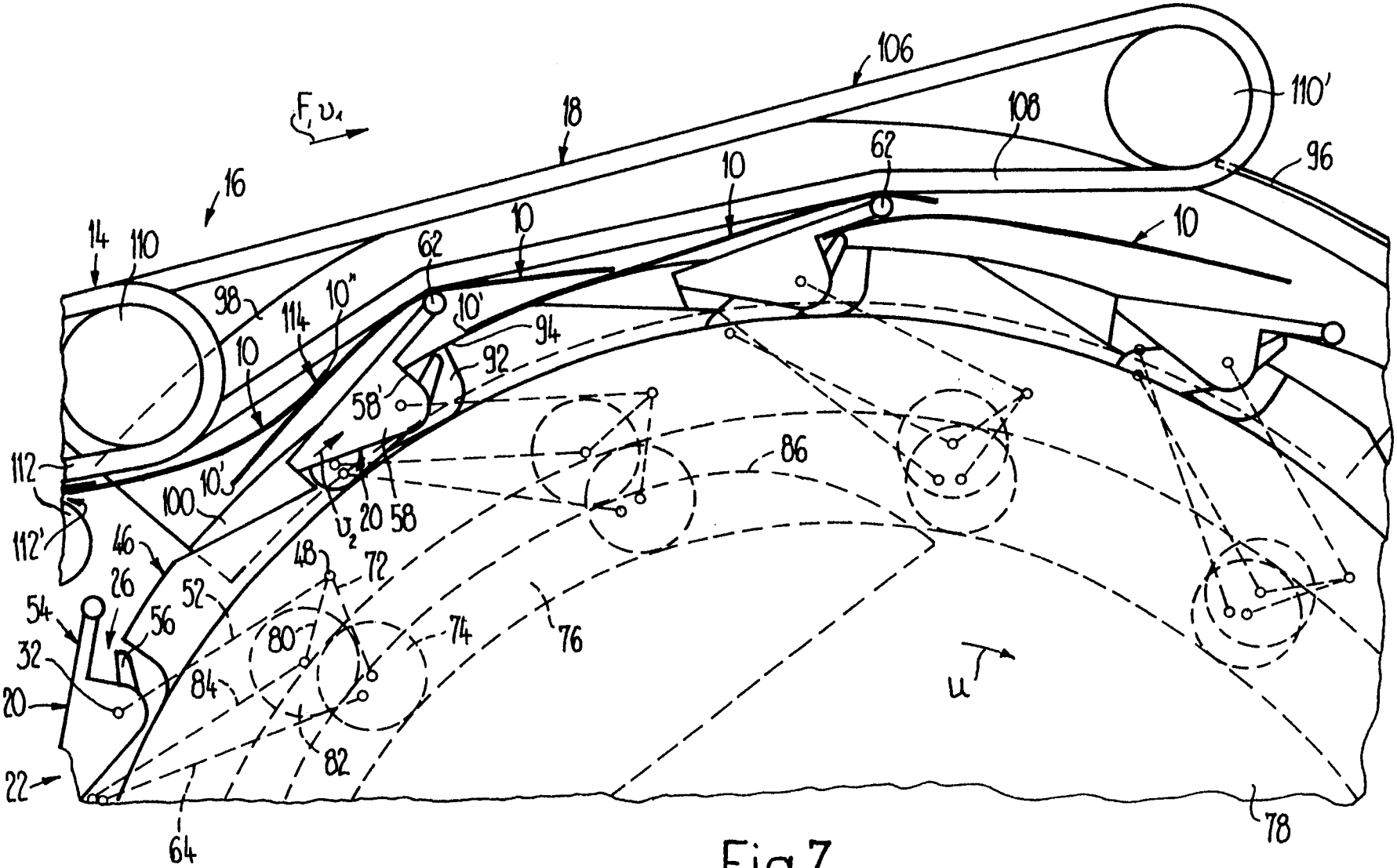

As can be seen in particular in FIGS. 1, 6 and 7, products 10 are fed in imbricated formation 114, each product resting on the preceding one, into the takeover region 18 by the conveying device 16. Consequently, the trailing edge 10' of each product 10 rests on the following product 10, on the side opposite the strap conveyor 106.

The takeover of the product 10 by the transfer conveyor 22 of conveying device 16 is illustrated by FIGS. 6 and 7 which show enlarged views of the takeover region 18 at two points in time (one half of a working cycle apart). The numerical designations in FIGS. 6 and 7 correspond to the numerical designations in FIGS. 1 through 5.

When a product 10 leaves the conveying nip 112' with its leading edge 10'', it passes directly into the takeover region 18 where the leading edge 10'' rests on the preceding product 10. However, as shown in FIG. 7, the product 10 is still held in conveying nip 112' and is further transported at conveying speed $v_1$. Then, as shown in FIG. 6, a clamp 20 catches up with a product 10 as result of the higher clamp speed $v_2$.

The product 10 is then pressed by the pressing roller 62 of the clamp 20 against the conveying strap 108 as illustrated by the clamp 20 on the far left hand side of FIG. 6. During further rotation, the pressing roller 62 of the clamp 20 continues to press the product 10 against the conveying strap 108 so that the product 10 is also held when its trailing edge 10' has left the conveying nip 112' (as illustrated by the second clamp 20 from the left in FIG. 7).

On further rotation, the conveying strap 108 is deflected upward due to the flexibility of the conveying strap and the fact that the path of the pressing roller 62 intersects an imaginary straight line of the conveying strap 108 between the deflecting rollers 110 and 110'. The deflection of the conveying strap 108 causes the product 10 to bend so that the trailing edge 10' of product 10 rests on the guide profiles 100 and then on the outer surface 94 of the carrying disks 46 (as shown be the central clamp in FIG. 6). At this point, the product 10 is still transported at conveying speed $v_1$ of the conveying strap 108.

The pressing roller 62 then continues to roll on the conveying strap, and the following clamp 20, having an opened clamp mouth 26 catches up with the product 10 and grasps the trailing edge 10' of product 10. At the end of the takeover region 18, the pressing roller 62, pressing the product 10 against the conveying strap 108, runs off the conveying strap 108. The following clamp 20 is then closed in order to seize and firmly hold this product 10 at the trailing edge 10' (as shown by the clamps on the far right in FIGS. 6 and 7).

The clamps 20 seize the product 10 securely. The bending of the products 10 and the raising of the conveying strap 108 by the clamp 20 ensures that the trailing edge 10' of the product is lifted from the conveying strap 108 or the following product 10 and is engaged by the first clamping jaw 54.

Furthermore, the guide profiles 100 and the outer surface 94 ensure that the second clamping jaw 56 engages the product 10. An exact alignment of the products 10 is ensured by the plates 58 that run with their edge 58' onto the trailing edge 10' of the products 10. Any turning, or lateral deviation of the products 10 is prevented by the guide surface 98.

The products 10 are consequently held and guided the whole time until they are seized by a clamp 20. The position of the products 10 is always exactly determine which allows for great processing capacity and in particular, any desired position for the conveying device 16 and for the transfer conveyor 22.

Figure 8:
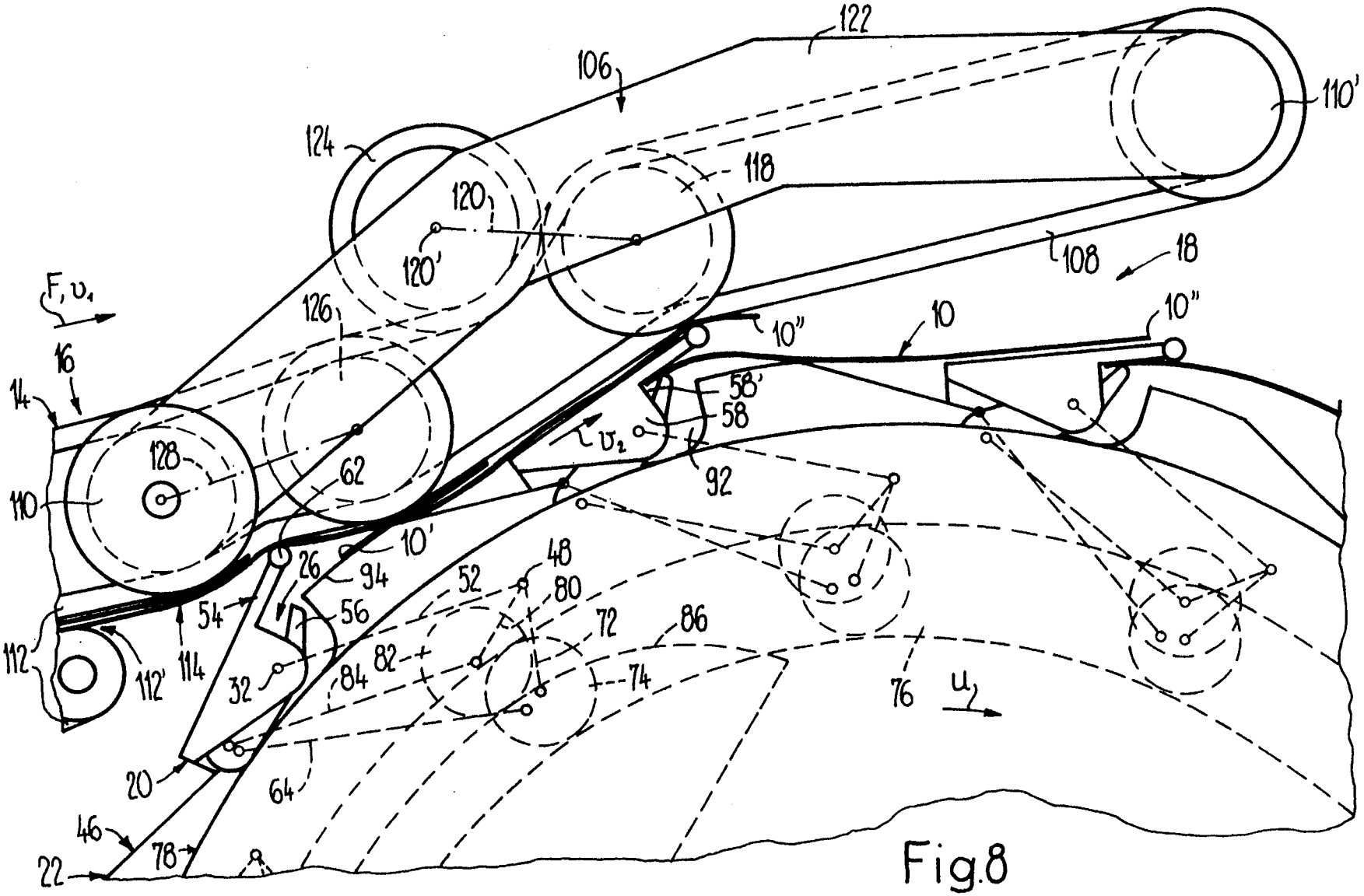
FIGS. 8 and 9 illustrate another embodiment of the conveyor belt in the takeover region at two different points in time during a working cycle.
Figure 9:
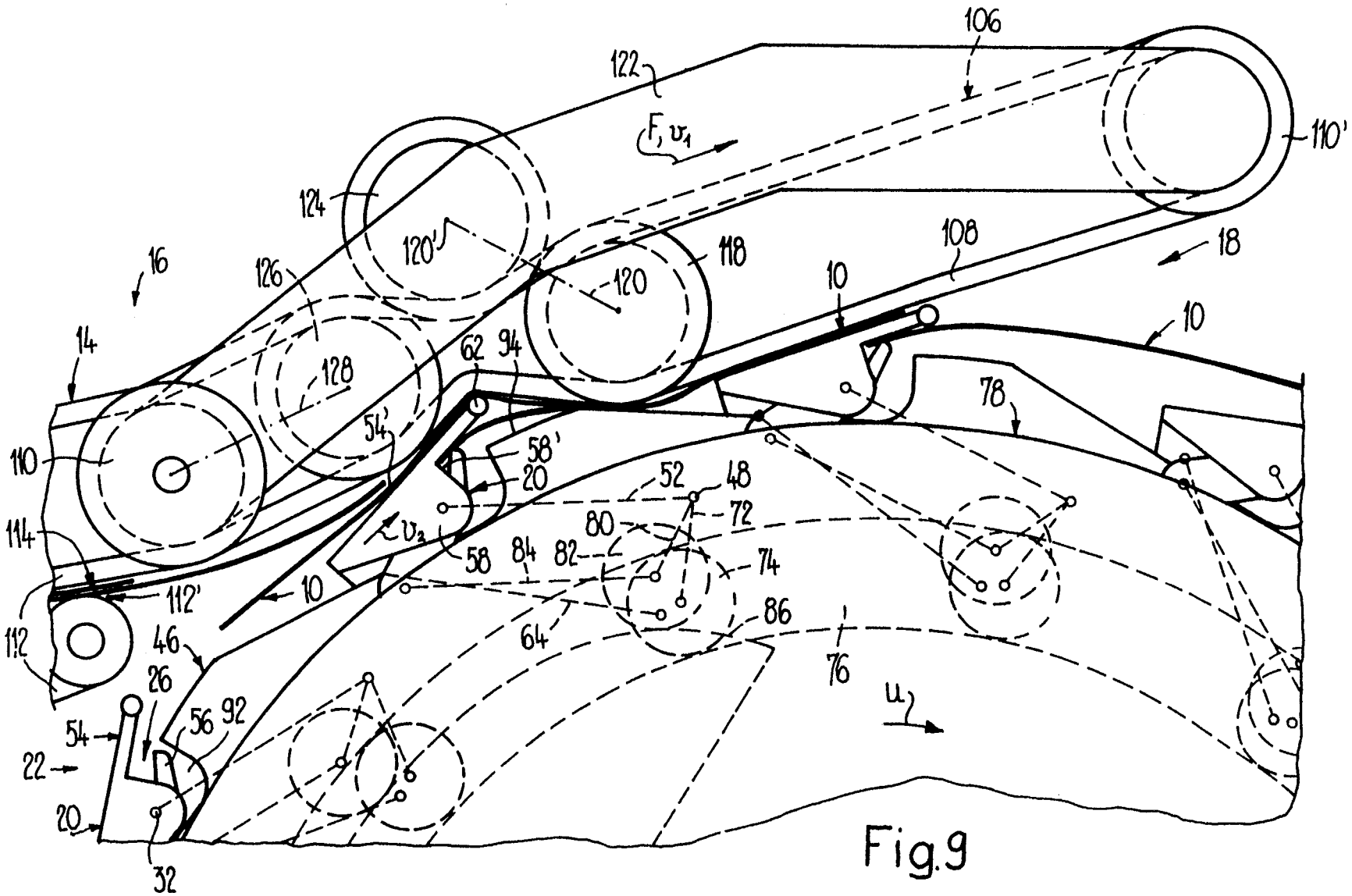

Another preferred embodiment of the conveying device 16 is shown in FIGS. 8 and 9. The conveying strap 108 of the strap conveyor 106 is wrapped around the fixed deflecting rollers 110 and 110' at the end of the conveying nip 112', and at the end of the takeover region 18 respectively. The conveying strap 108 is driven in conveying direction F at conveying speed $v_1$.

Centrally located, between deflecting rollers 110 and 110', is a first pressing wheel 118 which is arranged between the two strands of the conveying strap 108. The pressing wheel 118 is rotatably mounted at the one end of a lever 120. The opposite end of the lever 120 is mounted on a bearing plate 122 of the conveying device 16 so that it swivels about swivel axis 120'.

A tension wheel 124 is rotatably mounted about the swivel axis 120' of the lever 120. At a point between the deflecting roller 110 and the first pressing wheel 118, the tension wheel 124 presses the upper, non-active strand of the conveying strap 108 in the direction toward the lower active strand. Furthermore, between the tension wheel 124 and the deflecting roller 110, a second pressing wheel 126 is rotatably mounted at the free end of a second lever 128. The second pressing wheel 126 is between the two strands of the conveying strap 108 and is swivel-mounted about the axis of the deflecting roller 110.

Between the deflecting rollers 110 and 110' there are two flexible compliant supports which press the conveying strap 108 in a downward direction toward the transfer conveyor 22. The downwardly acting force is generated by the upper, non-active strand of the conveying strap 108 which flexibly prestresses the pressing wheels 118 and 126 downward on account of the tension wheel 124.

With respect to the preferred embodiment shown in FIGS. 8 and 9, the takeover of the products 10 from the conveying device 16 by the clamps 20 of the transfer conveyor 22 is accomplished in fundamentally the same manner as the embodiment according to FIGS. 6 and 7. Because of the multiple, flexible supports of the conveying straps 108 in the takeover region 18 situated between the deflecting rollers 110 and 110', the processing capacity can be further increased because a greater conveying speed $v_1$ and greater clamp speed $v_2$ are permissible with the same reliable and secure takeover of the products 10. Furthermore, the products 10 are held over a longer distance.

A product 10 leaving the conveying nip 112' of the pair of conveyor belts 112 (FIG. 9) is caught by a clamp 20 and pressed by the pressing roller 62 of the clamp 20 against the conveying strap 108 before the trailing edge 10' leaves the conveying nip 112' (FIG. 8). The product 10 is then transported at the conveying speed $v_1$. As a result of the higher clamp speed $v_2$, the following opened clamp 20 catches up with the product 10 and seizes the product 10 at the trailing edge 10'.

As a result of the deflection of the conveying strap 108 in the upward direction by the deflecting roller 62, the product 10 is in turn bent and pressed by the pressing wheel 126 in the downward direction against the upper side of the clamping jaw part 54' (FIG. 9) and then against the outer surface 94 of the carrying disks 46. Due to the S-shaped guidance of the conveying strap 108 between the deflecting roller 110 and the first pressing wheel 118, the detaching effect of the trailing region of the product 10 from the following product 10 is intensified. As soon as the clamp 20 has caught up with the respective product 10, the clamp is closed and seizes the product 10 at the trailing edge 10' (as illustrated in FIG. 9) in the region between pressing wheels 118 and 126.

Since the products 10 in the takeover region 18 are not displaced relative to one another, products 10 which are larger can also be processed. Larger products are pressed for a time by two clamps 20 against the strap conveyor 106. It is also possible to process products 10 which are fed to the takeover region 18 which are not in imbricated formation. In this case, it is advantageous to use the embodiment illustrated in FIGS. 8 and 9 because the products 10 are held to the conveying straps 108 not only by the pressing rollers 62, but also by the clamping jaw part 54' and the carrying disks 46. The material is in that case chosen such that the friction between the products 10 and the strap conveyor 106 is significantly greater than between the products 10 and the corresponding parts of the transfer conveyor 22.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, the scope of the invention is, therefore, indicated by the appended claims rather than by the foregoing description. All changes which come within the meaning and range of equivalency of the claims are to be embraced within their scope.

I claim:

1. An apparatus for transporting sheet-like products comprising:

a continuously circulating belt conveyor having a flexible conveyor belt driven in a conveying direction at a conveying speed for transporting the products;

a takeover conveyor having a rotating carrying member driven in a second rotating direction;

a plurality of individually controllable clamps successively mounted on the carrying member to rotate at a clamp speed, the clamps having a first clamping jaw and a second clamping jaw and a clamp mouth defined therebetween;

a takeover region wherein the products are transferred from the conveyor belt to the clamps;

in the takeover region, the clamp speed being greater than the conveying speed, the clamp mouth being directed forward in the conveying direction to seize the products at their trailing end, and the first clamping jaw of the clamps facing the conveyor belt and pressing the product to be seized by a following clamp against the conveyor belt firmly enough to be taken along, in order to convey it further at the conveying speed; and means disposed on the first clamping jaw for permitting relative movement between the first clamping jaw and the product.

2. The apparatus as claimed in claim 1, wherein the means for permitting relative movement comprises a freely rotatably mounted pressing roller mounted on the free end of the first clamping jaw, by which the first clamping jaw presses the printing products against the conveyor belt.

3. The apparatus as claimed in claim 1, comprising guiding means for supporting the trailing edge of the products, bent on account of the pressing against the conveyor belt, on the side facing away from the conveyor belt and for directing the trailing edge into the clamp mouth.

4. The apparatus as claimed in claim 1, comprising compliantly suspended pressing rollers supporting the conveyor belt in the takeover region on the side facing away from the takeover conveyor.

5. The apparatus as claimed in claim 1, comprising a pair of conveyor belts arranged upstream of the conveyor belt of the belt conveyor forming a conveying nip to feed the products to the conveyor belt, the first clamping jaw of a clamp in each case pressing a product against the conveyor belt before the trailing edge of the product leaves the conveying nip.

6. The apparatus as claimed in claim 1, wherein the belt conveyor conveys the products spaced apart from one another or in an imbricated formation, in which the trailing edge of the products respectively bears against the following product on the side of the following product facing away from the conveyor belt.

7. The apparatus as claimed in claim 1, wherein the carrying member comprising a wheel-like structure and is rotatingly driven about its axis, and the clamps are swivel-articulated on the carrying member.

8. An apparatus for transporting sheet-like products comprising:

a continuously circulating belt conveyor having a flexible conveyor belt driven in a conveying direction at a conveying speed for transporting the products;

a takeover conveyor having a rotating carrying member driven in a second rotating direction;

a plurality of individually controllable clamps successively mounted on the carrying member to rotate at a clamp speed, the clamps having a first clamping jaw and a second clamping jaw and a clamp mouth defined therebetween;

a takeover region wherein the products are transferred from the conveyor belt to the clamps;

in the takeover region, the clamp speed being greater than the conveying speed, the clamp mouth being directed forward in the conveying direction to seize the products at their trailing end, and the first clamping jaw facing the conveyor belt and pressing the product to be seized by a following clamp against the conveyor belt firmly enough to be taken along, in order to convey it further at the conveying speed; and a freely rotatably mounted pressing roller mounted on the first clamping jaw, the pressing permitting relative movement between the first clamping jaw and the product.

* * * * *